US010890140B2

(12) United States Patent
Nagata et al.

(10) Patent No.: US 10,890,140 B2
(45) Date of Patent: Jan. 12, 2021

(54) CARBURETOR FUEL CONTROL

(71) Applicant: WALBRO LLC, Tucson, AZ (US)

(72) Inventors: Noriyu Nagata, Shibata-Gun (JP); Hidenori Sasaki, Shibata-Gun (JP); Masashi Sasaki, Kakuda (JP); Daisuke Sato, Katta-Gun (JP); Hitoshi Terakado, Sendai (JP)

(73) Assignee: Walbro LLC, Tucson, AZ (US)

( * ) Notice: Subject to any disclaimer, the term of this patent is extended or adjusted under 35 U.S.C. 154(b) by 377 days.

(21) Appl. No.: 15/546,813

(22) PCT Filed: Feb. 3, 2016

(86) PCT No.: PCT/US2016/016397

§ 371 (c)(1),
(2) Date: Jul. 27, 2017

(87) PCT Pub. No.: WO2016/126839

PCT Pub. Date: Aug. 11, 2016

(65) Prior Publication Data

US 2018/0023514 A1 Jan. 25, 2018

Related U.S. Application Data

(60) Provisional application No. 62/111,717, filed on Feb. 4, 2015.

(51) Int. Cl.
*F02M 9/10* (2006.01)
*F02M 19/04* (2006.01)
(Continued)

(52) U.S. Cl.
CPC ..... *F02M 9/10* (2013.01); *F02M 5/12* (2013.01); *F02M 17/04* (2013.01); *F02M 19/04* (2013.01); *F02M 9/02* (2013.01); *F02M 9/08* (2013.01)

(58) Field of Classification Search
CPC ..... F02M 9/10; F02M 17/04; F02M 5/12; F02M 19/04; F02M 9/02; F02M 9/08; F02M 3/10
See application file for complete search history.

(56) References Cited

U.S. PATENT DOCUMENTS 4,102,952 A * 7/1978 Snipes ..... F02M 7/18 261/44.2
7,070,173 B2 * 7/2006 Dow ..... F02M 3/10 137/382

(Continued)

FOREIGN PATENT DOCUMENTS

DE 452148 C * 11/1927
DE 683168 C * 10/1939

(Continued)

OTHER PUBLICATIONS

International Search Report and Written Opinion of the International Searching Authority in PCT/US2016/016397 dated May 24, 2016.

(Continued)

*Primary Examiner* — Stephen Hobson
(74) *Attorney, Agent, or Firm* — Reising Ethington P.C.

(57) ABSTRACT

A carburetor fuel flow control device having an elongate annular body received in a cavity with an inlet in its side-wall communicating with a fuel supply passage and an outlet downstream of the inlet and adjacent to an end of the body, and a needle valve with a metering portion adjacent one end rotatably and slidably received in the body with the metering portion at least partially lapping or blocking the inlet to change the effective flow area of the inlet in response to generally axial movement of the needle valve relative to the inlet.

19 Claims, 5 Drawing Sheets

(51) Int. Cl.

| | |
|---|---|
| ***F02M 5/12*** | (2006.01) |
| ***F02M 17/04*** | (2006.01) |
| *F02M 9/08* | (2006.01) |
| *F02M 9/02* | (2006.01) |

(56) References Cited

U.S. PATENT DOCUMENTS

| | | | | |
|---|---|---|---|---|
| 2004/0036184 | A1 | 2/2004 | Nonaka | |
| 2004/0075180 | A1 | 4/2004 | Nonaka | |
| 2004/0251565 | A1 | 12/2004 | Douyama et al. | |
| 2005/0062176 | A1 | 3/2005 | Nonaka | |
| 2005/0236722 | A1 | 10/2005 | Dow et al. | |
| 2006/0151893 | A1* | 7/2006 | Horikawa | F02M 17/04 261/44.6 |
| 2018/0156160 | A1* | 6/2018 | Nonaka | F02M 9/085 |
| 2019/0360432 | A1* | 11/2019 | Habu | F02M 19/021 |
| 2020/0032742 | A1* | 1/2020 | Tobinai | F02M 9/08 |

FOREIGN PATENT DOCUMENTS

| | | | | |
|---|---|---|---|---|
| EP | 2860383 | A1 * | 4/2015 | |
| FR | 598841 | A * | 12/1925 | F02M 9/08 |
| FR | 812641 | A * | 1/1936 | |
| FR | 928775 | A * | 4/1941 | |
| FR | 1481601 | A * | 5/1966 | |
| GB | 252389 | A * | 8/1927 | F02M 17/36 |
| JP | 2802220 | B2 * | 10/1998 | |
| JP | 11-351065 | A | 12/1999 | |

OTHER PUBLICATIONS

CN Office Action for CN Application No. 201680008997.2 dated May 29, 2019 (17 pages).

* cited by examiner

CARBURETOR FUEL CONTROL

REFERENCE TO CO-PENDING APPLICATIONS

This application claims the benefit of U.S. Provisional Patent Application No. 62/111,717 filed Feb. 4, 2015 which is incorporated herein by reference in its entirety.

TECHNICAL FIELD

The present disclosure relates generally to carburetors and more particularly to a fuel control device for a carburetor.

BACKGROUND

Many carburetors for gasoline powered utility engines have a needle valve assembly for adjusting the flow rate of fuel supplied to an air and fuel mixing passage of the carburetor. The needle valve has a shank threadably received in a cavity in a carburetor body and a tapered or conical tip which cooperates with an annular valve seat in the cavity to vary and control the flow rate of fuel passing between them by rotating the valve to advance or retract the conical tip relative to the valve seat.

SUMMARY

In some implementations a somewhat flexible body with a central passage is received in a carburetor valve cavity and has an axially elongate inlet passage communicating with a fuel supply passage and an outlet downstream of the inlet, and a needle valve having a shank received in the valve cavity with a cylindrical metering portion slidably and rotatably received in the central passage and axially movable to at least partially block the inlet to change the effective flow area of the inlet into the central passage. In some implementations the cylindrical metering portion is received in the central passage with an interference fit and the needle valve is in one piece, threadably engaged with the valve cavity, and has a head with a tool engaging feature for rotating the needle valve.

BRIEF DESCRIPTION OF THE DRAWINGS

The following detailed description of certain embodiments and best mode will be set forth with reference to the accompanying drawings, in which.

DETAILED DESCRIPTION

Figure 1:
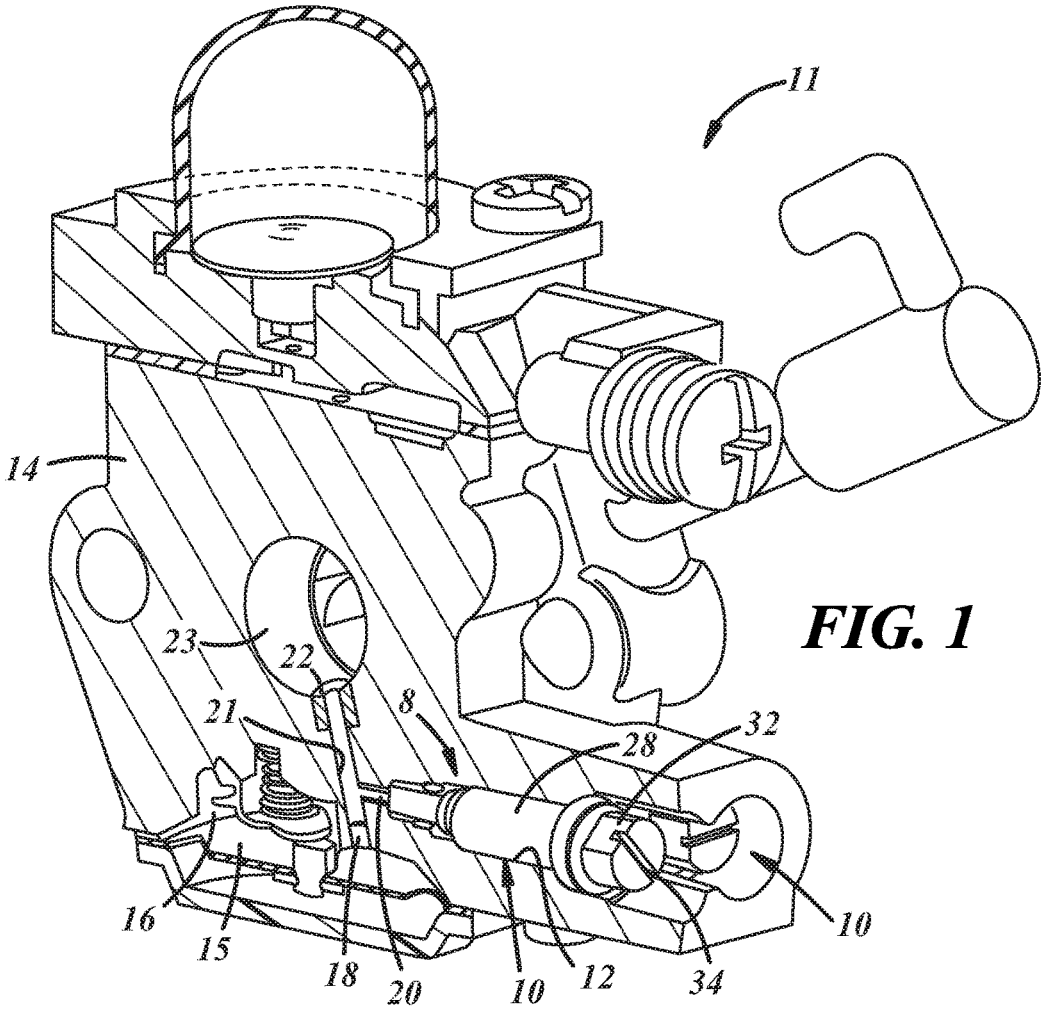
FIG. 1 is a cross sectional view of one implementation of a carburetor having a fuel control device.

Referring in more detail to the drawings, FIG. 1 illustrates a fuel control device 8 for a carburetor such as a float bowl, rotary barrel valve, butterfly valve or diaphragm type carburetor 11. The fuel control device 8 is at least partially received in a bore or cavity 12 of a carburetor body 14 and is adjustable to meter and control or limit the flow rate of fuel delivered from the carburetor. The carburetor 11 may be a diaphragm type carburetor that has a flexible diaphragm 15 that controls the pressure of fuel in a fuel metering chamber 16. The fuel metering chamber 16 communicates with the cavity 12 through a passage 18 and the fuel control device 8 controls the rate of fuel flow through an outlet bore 20 to a nozzle bore 21 in the carburetor body 14. The nozzle bore 21 contains a nozzle 22 or orifice through which fuel is drawn into a fuel and air mixing passage 23 to be mixed with the air flowing therethrough, with the resulting fuel and air mixture then being supplied to an operating engine. Accordingly, adjustment of the fuel flow rate past the fuel control device 8 affects the fuel flow rate to and through the nozzle 22 and hence, the richness of the fuel and air mixture delivered to the engine.

Figure 2:
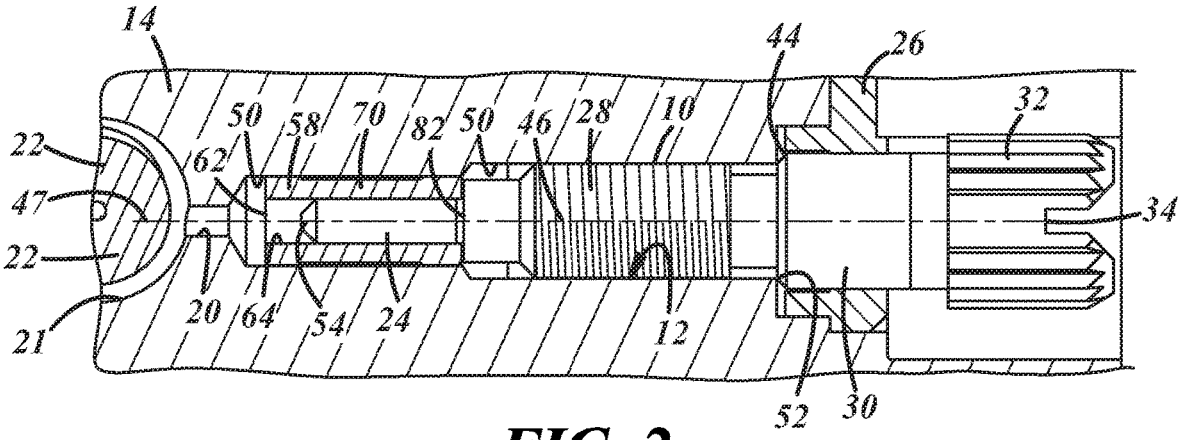
FIG. 2 is a fragmentary sectional view showing a portion of a body of the carburetor and the fuel control device.
Figure 3:
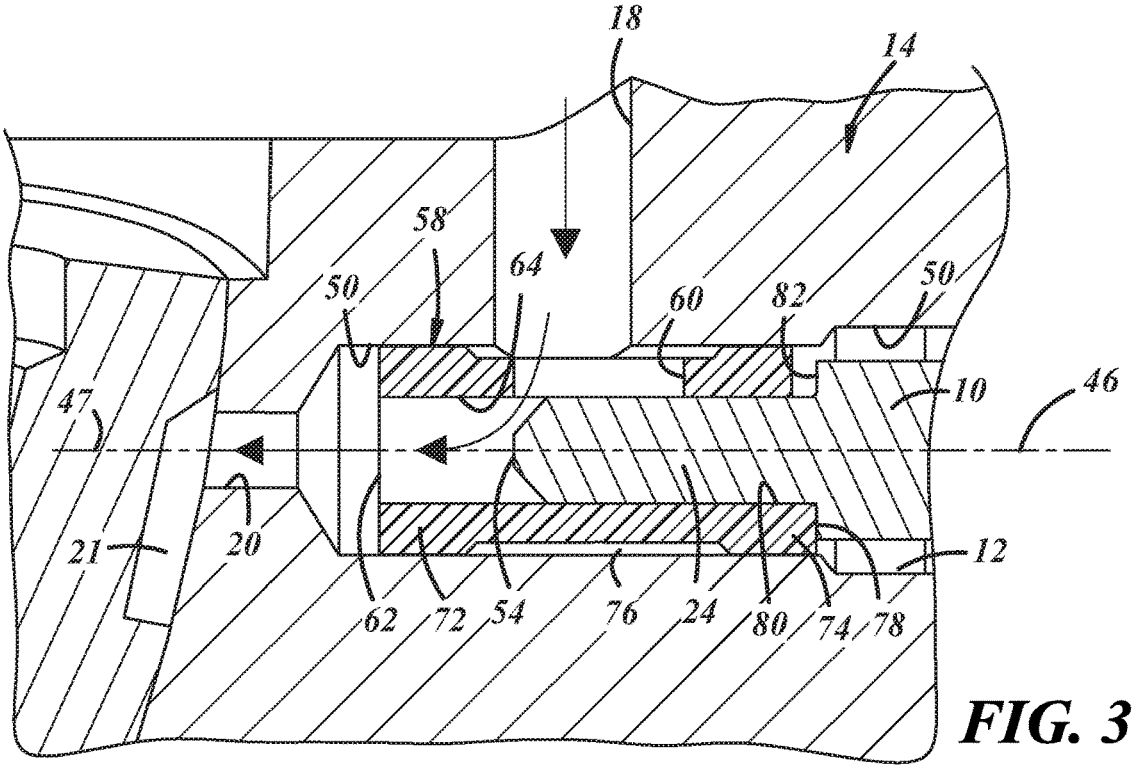
FIG. 3 is a fragmentary sectional view showing a portion of a body of the carburetor and a portion of the fuel control device.

The fuel control device 8 may, in at least some implementations, take the form of a needle valve and one or more such valves may be provided in a carburetor. At least some implementations of the carburetor may include two needle valves 10 rotatably carried by the carburetor body 14 in separate cavities 12 (only one of which is shown) formed in the body. Rotation of the needle valves 10 relative to the carburetor body 14 in one direction advances the needle valves further into the carburetor body and rotation in the other direction retracts the needle valve from the carburetor body. Such rotation of the needle valves 10 moves an end portion 24 of the needle valve relative to a port or the passage 18 to control the flow rate of fuel through that port or passage. In the implementation shown, one needle valve controls fuel flow through part of a low speed fuel circuit and the other needle valve controls fuel flow through part of a high speed fuel circuit. Each needle valve 10 may receive a limiter cap to control or limit rotation of the valves and hence, adjustment of the flow rate of fuel through the respective fuel circuit in the carburetor 10. The needle valves 10 may be arranged generally parallel to each other, side-by-side, and may be rotated independently of each other through at least a portion of their adjustment range. Each needle valve 10 and cavity 12 may have the same features and so only one needle valve 10 and cavity 12 will be shown and described in detail. The needle valve 10 shown in FIG. 1 is representative and the needle valve 10 shown in FIGS. 2 and 3 illustrate one presently preferred implementation of the needle valve. Of course, other arrangements may be used.

The needle valve 10 may have a shank 28 with a threaded portion 30 that engages complementary threads formed in the cavity 12, or in a retainer 26 adjacent to or partially received in the cavity 12. A head 32 of the needle valve 10 may extend axially from a rear end of the shank 28 and, in order to rotate and adjust the valve 12, a tool receiving feature, such as a recess or slot 34 may be defined in the head 32 to facilitate rotation of the needle valve 10. Of course, the tool receiving feature 34 may be formed in any desired shape or orientation, and may include a projection rather than a cavity or slot. The needle valve 12 may include one or more shoulders 44 or other features adapted to provide a stop surface limiting advancement of the needle valve into the carburetor body 14 or to engage a seal within the carburetor body 14 to inhibit or prevent fuel leaking from the carburetor 10.

The shank 28 and needle valve 10 generally, may be symmetrical about an axis 46 of rotation, and may be concentric with an axis 47 of the cavity 12. The cavity 12 may be defined at least in part by or include or communicate with the outlet bore 20 which may be spaced from the end portion 24 of the needle valve 10 and leading to the main fuel nozzle passage 21 and one or more counterbores 50 that define radially inwardly extending shoulders that may be generally complementarily arranged with respect to the shoulders and corresponding surfaces of the needle valve so that the needle valve is closely received within the cavity. At least one cavity shoulder 52 may be engaged by a needle valve shoulder to define a fully inserted or advanced position of the needle valve 10 relative to the carburetor body 14. In at least some implementations, the needle valve shoulder 44 is located between the threaded portion 30 and the end portion 24, and is shown in FIG. 2 as being located immediately adjacent to the threaded portion 30. This shoulder 44 engages the cavity shoulder 52 at an outer surface of or entrance to the cavity 12, in the implementation shown.

The end portion 24 of the needle valve 10 may include or define a metering portion that adjusts the size or flow area of the fuel flow path between the passage 18 and the bore 20. In at least some implementations, the metering portion 24 is defined by or includes an axial end 54 of the needle valve 10, although the metering portion could be spaced from the end 54. In the implementation shown, the metering portion 24 is defined by the end portion of the needle valve and is cylindrical, with a constant diameter. Of course, other shapes and arrangements may be used as desired, and the metering portion 24 may be defined by all or only a portion of the constant diameter end portion, or otherwise shaped end portion.

Figure 4:
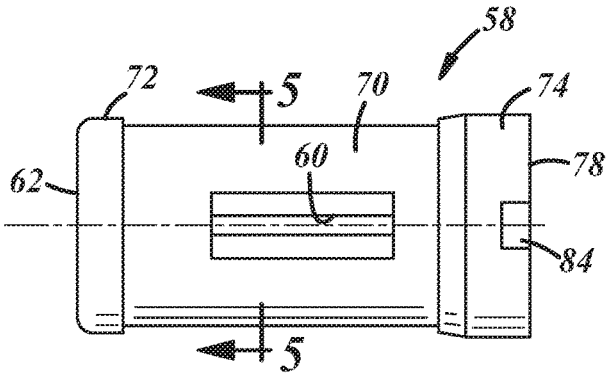
FIG. 4 is a side view of a metering body.
Figure 5:
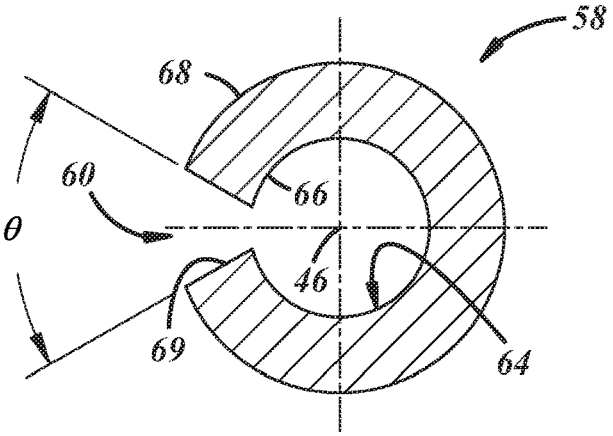
FIG. 5 is a cross sectional view of the metering body.

To control the flow rate of fuel as indicated above, the metering portion 24 of the needle valve is adjusted or moved relative to a port or passage through which fuel flows. The port or passage may be defined within the carburetor body itself, or in a separate component. In at least some implementations, including that shown in FIGS. 2 and 3, a flow control body 58 is received within the cavity 12 and includes an inlet 60 in fluid communication with the passage 18 and an outlet 62 in fluid communication with the bore 20 and fuel nozzle bore 21 downstream thereof. The body 58 may be generally cylindrical and has a central passage 64 in which at least a portion of the needle valve metering portion 24 is received, and the central passage may be concentrically and coaxially aligned with the metering portion. In the implementation shown, a portion of the central passage 64 not occupied by the needle valve 10 communicates the inlet 60 with the outlet 62 to provide a fuel flow path between them. At least this portion of the central passage 64, up to and including all of the central passage 64, is parallel to and preferably coaxial with the metering portion 24. The inlet 60 may be defined by a void or opening through the body 58 that is not parallel to the central passage 64, and in the implementation shown, is perpendicular to the central passage. The inlet 60 may be directly aligned with the passage 18 such that at least a portion of the inlet radially overlaps (relative to an axis of the passage 18) or is axially aligned (relative to the axis 46) with the passage 18 such that fuel may flow directly from the passage 18 through the inlet 60. This may simplify the flow path by removing one or more turns or bends through which the fuel would otherwise have to flow to reach the outlet 62. The inlet 60 may be defined by a slot formed through a wall of the body. The inlet 60 may have any desired size and shape. In the implementation shown, the intersection of the inlet 60 and the central passage 64 is a rectangle having constant width (in the circumferential direction) over its axial length. This axially elongate rectangular configuration negates the adverse affect of fuel viscosity variations and decreases the likelihood of fuel vaporization. The inlet 60 may be tapered, as shown in FIGS. 4 and 5, such that the circumferential width (relative to axis 46) of the inlet 60 increases from the inner surface 66 to its outer surface 68. This may help to funnel fuel into the inlet and/or it may facilitate molding the body 58 and removing the body from the tool or mold used to form the body. The sidewalls 69 of the inlet may be inclined or tapered relative to each other at an acute inclined angle in the range of about 45° to 75°, desirably 50° to 70° and preferably about 60°.

The flow control body 58 may include a mid-section 70 with a reduced outer diameter compared to portions 72, 74 of the body axially outboard of the mid-section. The portions 72, 74 axially outboard of the mid-section, in at least some implementations, include the ends of the body 58 and are received with an interference fit within the cavity 12. The inlet 60 is formed in the mid-section 70 and any fuel that does not flow through the inlet may be received in a circumferential/annular gap 76 (FIG. 3) between the body and the carburetor body 14, and that fuel may eventually flow into the inlet. The enlarged diameter ends 72, 74 engage the carburetor body 14 and may provide a seal outboard of the mid-section 70 to prevent or substantially inhibit fuel from leaking out of the gap 76. The body 58 may be formed of an at least somewhat flexible material and may accommodate some eccentricity or misalignment of the metering portion 24 relative to the cavity 12, such as may occur, for example, when the threads of the threaded portion 30 are not concentric with at least a portion of the cavity 12. At least an inlet end 78 of the body may include a tapered inner surface 80 (FIG. 3), providing a larger inner diameter at the outer end than at locations toward the mid-section 70. This may facilitate receipt of the needle valve metering portion 24 within the passage 64, and may also provide clearance (or less interference) between the metering portion and at least part of the enlarged diameter end 74. With this clearance, the primary contact between the metering portion 24 and the body 58 may be within the mid-section 70 which may flex relative to the carburetor body 14 (due at least in part to the gap 76 between them) to accommodate at least some misalignment of the metering portion 24 and cavity 12. The contact within the mid-section 70 also provides a seal between the metering portion 24 and the body 58 to prevent or at least inhibit fuel from leaking between them. The diameter of the metering portion 24 may be equal to or slightly larger than the inner diameter of at least a portion of the mid-section 70 (e.g. a portion adjacent to the inlet end 78 and leading to the inlet 60). In at least some implementations, this may reduce or eliminate changes in the fuel flow rate due to eccentricity between the needle valve 10 and cavity 12, or cocking or side loading of the needle in use, as the size of the open area of the inlet 60 would not be affected by such things nor would the seal between the metering portion 24 and body 58.

The flow control body 58 may be installed into the cavity 12 in any desired manner. In one method, the body 58 is pressed partially onto the metering portion 24 of the needle valve 10 (e.g. in an orientation to ensure desired alignment of the inlet 60 with the carburetor passage 18 when fully installed) and the needle valve 10 is installed into the cavity 12. The body 58 will be pressed into the counterbore 50 in the cavity 12 and will eventually engage a needle valve shoulder 82 adjacent to the metering portion 24. The fully installed position of the body 58 may coincide with the fully advanced position of the needle valve 10 wherein the needle shoulder 44 engages the cavity shoulder 52 as described above. In this position, the metering portion 24 axially overlaps and blocks at least a portion of the inlet 60 and thereby reduces the effective flow area of the inlet through which fuel may flow. From this fully advanced position, the needle valve 10 may be rotated in the opposite direction to at least partially back out or withdraw the metering portion 24 from the body 58 (i.e. move the needle valve axially relative to the body) and open or further open the inlet 60, thereby increasing the effective flow area of the inlet. Instead of putting the body 58 onto the metering portion 24 before the needle valve 10 is inserted into the cavity 12, the body 58 can be at least partially pressed into the counterbore 50, using a separate tool, before the needle valve 10 is installed into the cavity 12. For this purpose, the body 58 may include an alignment feature, such as a notch 84 (FIG. 4), that may facilitate installing the body in a desired orientation, with the inlet 60 directly overlapping/aligned with the passage 18. If desired, the fully installed position of the body 58 may be achieved upon moving the needle valve 10 to its fully advanced position as in the other method. This may help to consistently define the fully installed position of the body 58 across a production run of carburetors 11 and reduce variation among carburetors. Consistent positioning of the body 58 and needle valve 10 may facilitate calibration of the fuel flow in the carburetor.

Conventional needle valves utilize a tapered tip of the needle that is axially movable relative to a valve seat to increase or decrease the width of an annular flow gap between the tip and the carburetor body. The radial width of the annular gap is small and subject to becoming at least partially clogged by debris, including but not limited to particles of filtration material, which reduces the effective flow area of the flow gap. Further, eccentricity between the tapered tip and carburetor body provides an uneven flow gap (radially smaller in some areas and larger in others) that changes the fuel flow characteristics therethrough. Further, the tapered tip provides a non-linear change to the flow gap area for a given axial movement of the needle valve, and this can decrease the sensitivity of the needle valve (i.e. a small axial movement may result in a large change in fuel flow rate). These things individually or in combination can make calibration of the carburetors difficult because of the significantly different fuel flow characteristics that may be found among a production run of carburetors. That is, the amount of adjustment of the needle valve to achieve a desired fuel flow rate may vary more among different carburetors in a production run.

In at least some implementations, the metering portion 24 has a constant diameter, and the inlet 60 has a uniform width along its axial length and this permits a linear change to the open surface area of the inlet (its effective flow area) for a given axial movement of the needle valve 10. Further, instead of using an annular gap of relatively small width, the inlet 60 is provided in one open area whose smallest dimension is considerably larger than the radial width of the annular gap in prior needle valves. Hence, the inlet 60 is not prone to being clogged with debris. In at least some implementations, the smallest dimension of the flow area of the inlet 60 is at least 140 μm and in some implementations may be 200 μm or more. Further, the larger open area of the inlet facilitates fuel flow therethrough and reduces the number of turns and small gaps through which the fuel must flow, all of which tend to increase vapor generation in the fuel, especially when the carburetor may be at an elevated temperature.

Rotation of the needle valve 10 moves the metering portion 24 axially which uncovers or increasingly covers more of the axial length of the inlet 60, as desired, to provide a desired effective flow area of the inlet. Eccentricity between the needle valve 10 and cavity 12 is accommodated and does not change the flow area of the inlet or render the inlet more susceptible to blockage from debris. The linear movement of the metering portion and uniform width of the inlet provides greater consistency among carburetors. The ability to reliably calibrate and control fuel flow through the inlet is improved and the interference fit between the needle valve 10, flow control body 58 and carburetor body 14 resist unintended movement of the metering portion 24 relative to the inlet 60 such as may be caused by vibration or other forces in use of the carburetor. The straight and constant diameter metering portion 24 (in implementations were such is provided), also resists breaking during installation, such as sometimes occurs with tapered needle valve tips, for example, when fully advanced and not concentric with the valve seat that they engage. In at least some implementations, the metering portion 24 does not directly engage the carburetor body 14 and instead engages only the flow control body 58 which may be made of a polymeric or metallic material, as desired (if made of metal, appropriate o-rings or other seals may be used to provide a seal between the metering portion and body). A polymeric body 58 avoids the porosity problems with cast aluminum carburetor bodies in the area of the cavity and seat for conventional needle valve assemblies. A suitable polymeric material of body 58 may be POM such as Duracon M90-44.

Figure 6:
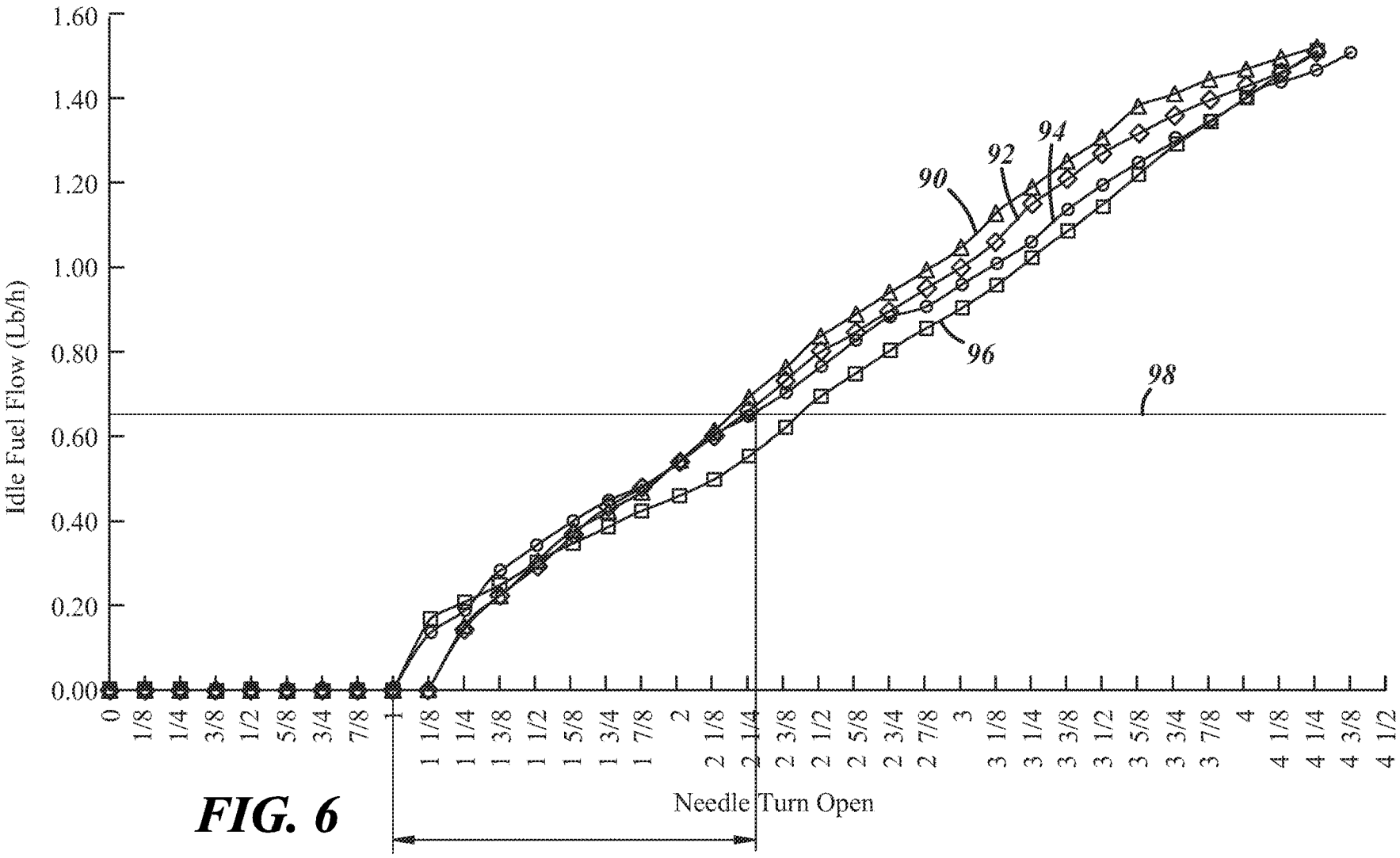
FIG. 6 is a graph showing changes in idle fuel flow rate with adjustments to representative fuel flow devices.

FIG. 6 illustrates the improved control of fuel flow that may be achieved by at least some implementations of the needle valve 10 and flow control body 58 in carburetors. Plot lines 90, 92 and 94 represent fuel flow rates achieved in three different carburetors having a needle valve 10 and flow control body 58 as described herein. The flow rates through the inlet 60 of the flow control bodies are plotted as a function of the position of the metering portion 24 relative to the body 58. The flow rates were measured at idle engine operation. Plot line 96 shows the flow rate through a needle valve having a tapered tip according to the prior art. The prior art valve arrangement requires greater movement of the needle valve to achieve a calibrated fuel flow rate, which is shown by line 98. And the variance among different prior art carburetors including the same valve arrangement is greater than the relatively small variation shown by plot lines 90, 92, 94 which all show a calibrated fuel flow rate at about 2.25 rotations of the needle valve. This low variability among the different carburetors facilitates calibration and control of fuel flow within the carburetors.

Figure 7:
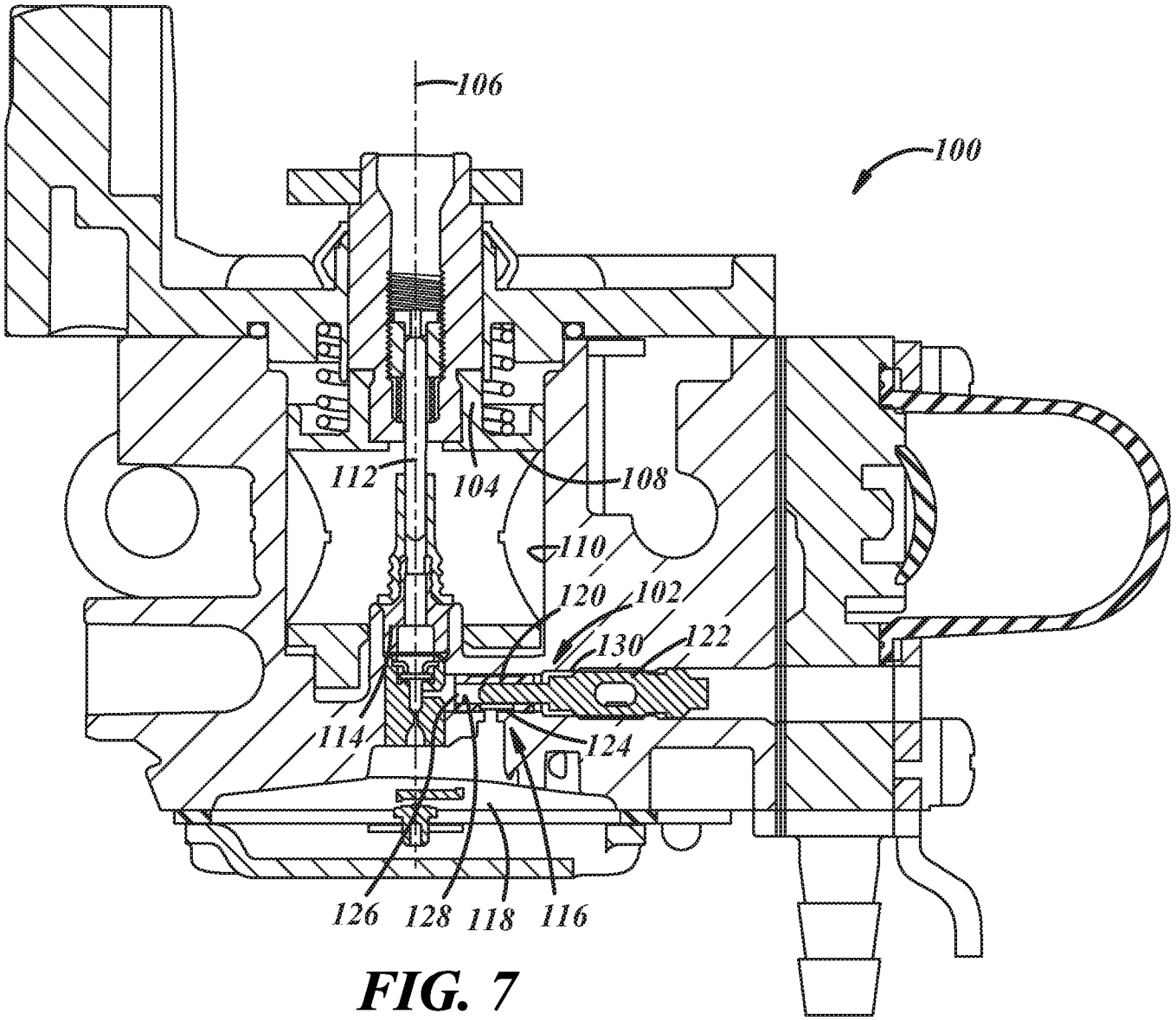
FIG. 7 is a cross sectional view of a rotary throttle valve carburetor with a fuel control device.

FIG. 7 illustrates a rotary throttle valve carburetor 100 including a fuel control device 102. FIGS. 1-5 illustrate use of the fuel control device in a butterfly-type carburetor, having a butterfly type throttle valve. The rotary throttle valve or barrel type carburetor 100 shown in FIG. 7 includes a throttle valve 104 that rotates about an axis 106 to increasingly vary the alignment of a throttle bore 108 formed in the throttle valve 104 with a fuel and air mixing passage 110 to thereby vary the fluid flow rate through the fuel and air mixing passage. As the throttle valve 104 rotates, it also moves axially (e.g. as controlled by a cam surface) to move a needle 112 relative to a main fuel nozzle 114 and thereby control the fluid flow rate through the main fuel nozzle. The fuel control device 102 may be received within a fuel circuit or fuel path 116 between the main fuel nozzle 114 and a metering chamber 118. As in the previously described embodiments, the fuel control device 102 may include a flow control body 120 and a needle valve 122. The flow control body 120 may be constructed in the same manner as the flow control body 58 already described, and may have an inlet 124 communicated with an outlet 126 via a passage 128. The needle valve 122 may also be the same as or similar to the needle valve 10 and have a metering portion 130 that may be at least partially received in the passage 128 to, in at least certain positions, at least partially block the inlet 124 to control the fluid flow rate through the inlet. The outlet 126 is communicated with the main fuel nozzle 114 through one or more passages or openings of the fuel path 116. The flow control body 120 and needle valve 122 may be installed into the carburetor 100 and may function in the same manner as previously described, if desired. The rotary valve carburetor 100 may be constructed as disclosed in U.S. Pat. No. 7,114,708 the disclosure of which is hereby incorporated by reference in its entirety.

Figure 8:
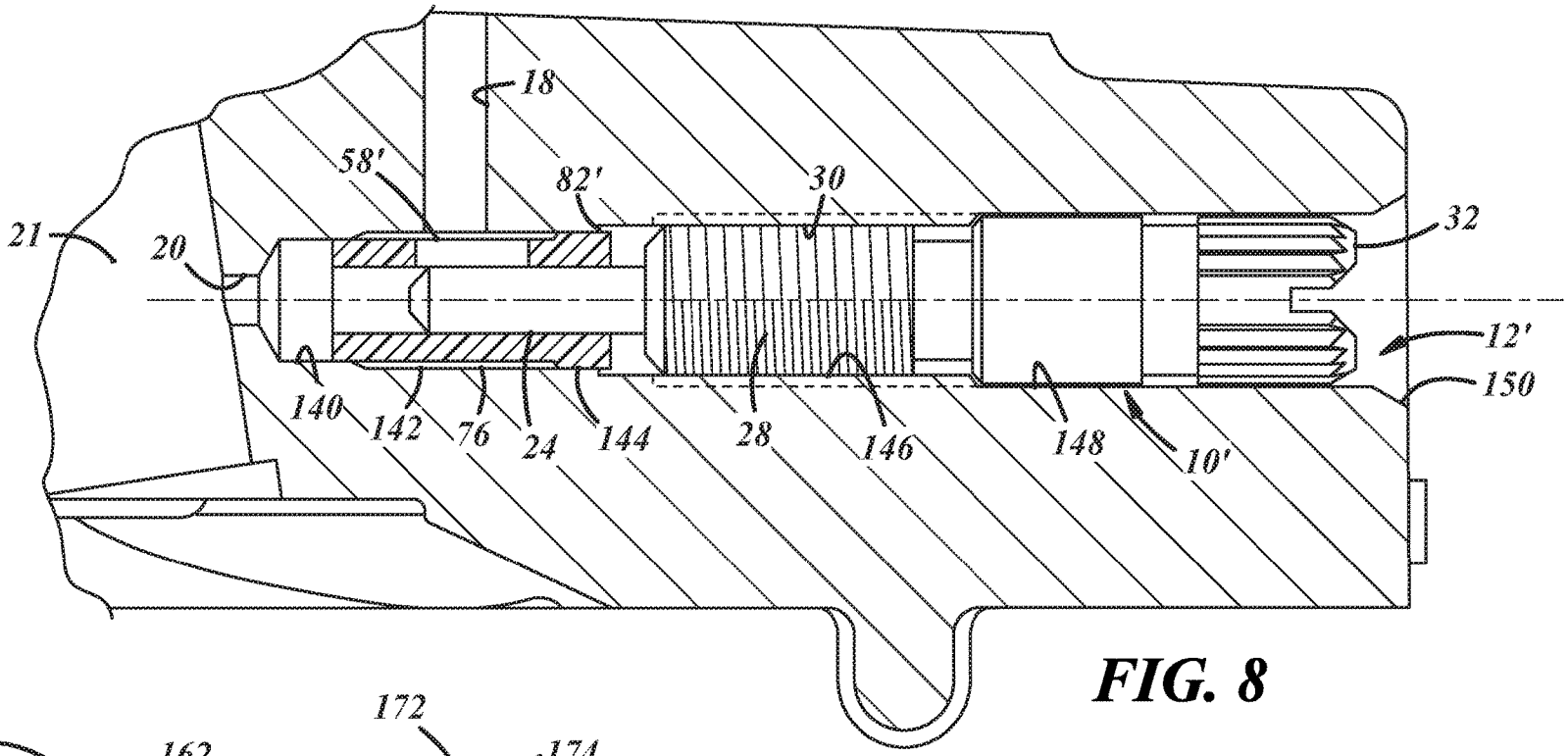
FIG. 8 is a fragmentary sectional view of a modified form of the fuel control device in a carburetor body.
Figure 9:
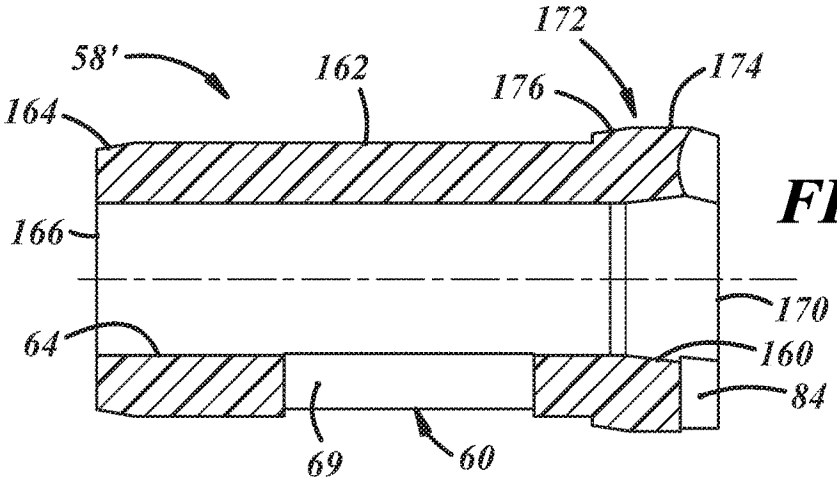
FIG. 9 is a sectional view of a modified body of the fuel control device of FIG. 8.

FIGS. 8 and 9 illustrate a modified form of a flow control body 58' received in a valve cavity 12' of a carburetor body. As shown in FIG. 8 the valve cavity 12' has a nozzle bore 20 communicating with a nozzle orifice passage 21 which preferably is coaxial with a counterbore 140 receiving an end portion of body 58' desirably with an interference fit to provide a seal between them, a second counterbore 142 with a somewhat larger diameter providing an annular gap or space 76 between the body and the cavity and communicating with the fuel supply passage 18, and desirably also receiving a circumferential rib 144 of the body preferably with an interference fit to provide a seal between them. A coaxial threaded third counterbore 146 receives a complentarily threaded portion 30 of a shank of a needle valve 10' and preferably a fourth coaxial counterbore 148 receives a head 32 of the needle valve. Desirably, the head 32 has a slot or other tool receiving feature to facilitate rotation of the needle valve to adjust the valve assembly. The counterbore 148 may blend into a chamfer or coaxial frusto-conical bore 150 opening onto an exterior of the carburetor body 14. Desirably the head 32 will have a configuration which cannot be engaged by conventional readily available tools such as a screwdriver, socket, Allen wrench, etc. to rotate the needle valve so that the valve assembly cannot be adjusted by an end user.

As shown in FIG. 9, the flow control body 58' has an axially elongate through bore 64 which adjacent one end opens into a frusto-conical bore 160 to facilitate insertion of the needle valve 10' into the body. The body has an outer axial elongate cylindrical surface 162 desirably coaxial with the bore 64 and in assembly received in the cavity counterbore 142 and has a diameter providing an annular space or gap 76 between them which communicates with the fuel supply passage 18.

Desirably the diameter of this cylindrical surface 162 is also slightly larger than the diameter of the cavity counterbore 140 to provide in assembly an interference fit creating a seal between them. Desirably the cylindrical surface 162 blends into a chamfer or frusto-conical surface 164 extending to the end 166 of the body to facilitate insertion of the end portion of the body into the cavity counterbore 140 during assembly. In a central portion the body has a through and axially elongate slot or inlet 60 desirably with tapered or inclined sidewall surfaces 69. This inlet 60 communicates with the fuel flow passage 18, the annular space or gap 76, and the interior central passage or bore 64 of the body 58'.

Adjacent the other end 170 the body has a circumferentially continuous rib 144 which desirably has a diameter somewhat larger than the diameter of the cavity counterbore 142 to provide in assembly a press fit or interference fit providing a seal between the body and the carburetor. Desirably this rib has a chamfer or frusto-conical surface 176 on the axially inner edge of the rib to facilitate insertion of the body 58' into the counterbore 142.

As shown FIG. 8, the valve 10' is desirably in one piece and has a shank with the cylindrical metering portion 24 adjacent one end, a head 32 adjacent its other end and, a threaded portion 28 between them engagable with complementary threads in the cavity counterbore 146 so that in assembly rotation of the needle valve in one direction advances the cylindrical portion 24 relative to the inlet 60 and rotation in the other direction retracts the cylindrical portion relative to the inlet to thereby change the effective area through the cylindrical metering portion 24 preferably has a diameter slightly larger than the diameter of the bore 64 of the control body to provide in assembly an interference fit to provide a fluid seal between them in at least a portion of the bore 64 between the outer end 170 and the adjacent axial end of the inlet 60 which fuel flows into the bore 64 of the body and through its outlet end 166. Desirably the needle valve has an essentially radially extending or right angle shoulder 82' which may facilitate use of the needle valve to initially insert and position the control body 58' into assembled relationship in the counterbores 140 and 142 of the valve cavity 12'. In some implementations this shoulder 82' may also engage a complementary annual shoulder between counterbore 144 and 146 of the valve cavity 12' to provide a positive stop limiting the extent to which the valve assembly may be inserted into the cavity and/or the cylindrical portion 24 into the control body 58'.

The control valve body 58' may be assembled with an interference fit or press fit into the counterbores of 140 and 142 of the valve cavity 12' in at least the same ways as described above with respect to assembly of the control body 58 into the cavity 12 and thus these ways are incorporated hereat by reference and will not be repeated.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A carburetor fuel flow control device, for a carburetor having a mixing passage, a valve cavity, a fuel supply passage opening into the cavity and a fuel outlet from the cavity, the device comprising:

an annular body of a somewhat flexible material having a sidewall and an axially elongate central passage through the body, the body adjacent each end having a circumferentially continuously exterior surface engaging a complementary portion of the valve cavity, an inlet through the sidewall communicating the supply passage with the central passage, and an outlet downstream of the inlet; and a needle valve having a shank received in the cavity and a cylindrical metering portion slidably and rotatably received with at least a close fit in the central passage and axially movable to at least partially block the inlet to reduce the effective flow area of the inlet into the body passage.

2. The device of claim 1 wherein the cylindrical metering portion has at least a portion with a circumferentially continuous interference fit with a portion of the body upstream of the inlet.

3. The device of claim 1 wherein an exterior circumferential portion of the body downstream of the inlet has an interference fit with a complementary portion of the cavity to provide a seal between them.

4. The device of claim 1 wherein a portion of an exterior surface of the body upstream of the inlet has an interference fit with a complementary portion of the cavity to provide a seal between them.

5. The device of claim 1 wherein at least part of the cylindrical metering portion has an interference fit with the body, and the device further comprises an annular space between the exterior of the body and the cavity with the supply passage and the inlet communicating with the annular space.

6. The device of claim 5 wherein the exterior surface of the body also comprises a circumferentially continuous recess between and spaced axially inwardly from the ends of the body and at least in part forming the annular space between the body and the cavity.

7. The device of claim 1 wherein the central passage and the exterior surface of the sidewall of the body are substantially coaxial.

8. The device of claim 1 wherein the inlet is axially elongate.

9. The device of claim 8 wherein the inlet has a substantially uniform width along an axial length of the inlet.

10. The device of claim 8 wherein the inlet has tapered surfaces configured so that a circumferential width of the inlet increases from the inner surface to the outer surface.

11. The device of claim 10 wherein the tapered surfaces form an included angle in the range of 50 degrees to 70 degrees.

12. The device of claim 1 wherein the inlet is generally rectangular and has a substantially uniform circumferential width along an axial length of the inlet.

13. The device of claim 1 wherein the body also comprises a circumferentially continuous rib adjacent an end upstream of the inlet.

14. The device of claim 13 wherein the rib has an outer circumferentially continuous surface having an interference fit with a complementary portion of the valve cavity to provide a seal between them.

15. The device of claim 1 wherein the central passage merges into a chamfered surface having a maximum diameter adjacent an axially outboard end of the body which is greater than the diameter of the central passage.

16. The device of claim 15 wherein the tool engagement feature of the head has a non-circular configuration.

17. The device of claim 1 wherein the needle valve also comprises a head adjacent an end of the needle valve generally axially opposite to the cylindrical metering portion of the needle valve, and the head is received in the valve cavity and has a tool engagement feature configured so that a screwdriver, socket, or Allen wrench cannot rotate the valve to change the extent to which the cylindrical portion at least partially blocks the inlet to change the effective flow area of the inlet.

18. A carburetor for an engine comprising:

a carburetor body including a mixing passage, a valve cavity, a fuel supply passage opening into the cavity and a fuel outlet from the cavity;

an annular body of a somewhat flexible material having a sidewall and an axially elongate central passage through the body, the body adjacent each end having a circumferentially continuously exterior surface engaging a complementary portion of the valve cavity, an inlet through the sidewall communicating the supply passage with the central passage, and an outlet downstream of the inlet; and a needle valve having a shank received in the cavity and a cylindrical metering portion slidably and rotatably received with at least a close fit in the central passage and axially movable to at least partially block the inlet to reduce the effective flow area of the inlet into the body passage.

19. The carburetor of claim 18 wherein the cylindrical metering portion has at least a portion with a circumferentially continuous interference fit with a portion of the annular body upstream of the inlet.

* * * * *